US010149551B2

(12) United States Patent
Long

(10) Patent No.: US 10,149,551 B2
(45) Date of Patent: Dec. 11, 2018

(54) FLEXIBLE WALL SAFETY BASSINET

(71) Applicant: Patricia Long, Santa Barbara, CA (US)

(72) Inventor: Patricia Long, Santa Barbara, CA (US)

( * ) Notice: Subject to any disclaimer, the term of this patent is extended or adjusted under 35 U.S.C. 154(b) by 192 days.

(21) Appl. No.: 15/138,192

(22) Filed: Apr. 25, 2016

(65) Prior Publication Data

US 2016/0309912 A1 Oct. 27, 2016

Related U.S. Application Data

(60) Provisional application No. 62/152,591, filed on Apr. 24, 2015.

(51) Int. Cl.

| | |
|---|---|
| ***A47D 7/02*** | (2006.01) |
| ***A47D 7/04*** | (2006.01) |
| ***A47D 7/00*** | (2006.01) |
| ***A47D 7/01*** | (2006.01) |
| ***A47D 9/00*** | (2006.01) |

(52) U.S. Cl.

CPC ..... *A47D 9/00* (2013.01); *A47D 7/02* (2013.01); *A47D 7/04* (2013.01)

(58) Field of Classification Search

CPC ..... A47D 7/02; A47D 13/06; A47D 13/061; A47D 13/063; A47D 13/065; A47D 9/00

See application file for complete search history.

(56) References Cited

U.S. PATENT DOCUMENTS

| | | | |
|---|---|---|---|
| 1,133,429 | A | 3/1915 | Christensen |
| 2,804,631 | A | 9/1957 | Levin |
| 3,427,666 | A | 2/1969 | Saxe |
| 3,932,903 | A | 1/1976 | Adams |
| 3,971,083 | A | 7/1976 | Peterson |
| 4,706,312 | A | 11/1987 | Shamie |
| 4,811,436 | A | 3/1989 | Schwartz |
| 4,998,939 | A | 3/1991 | Potthast |
| 5,111,543 | A | 5/1992 | Epshetsky |
| 5,172,435 | A | 12/1992 | Griffin |
| 5,430,899 | A | 7/1995 | Chisolm |
| 5,581,833 | A | 12/1996 | Zenoff |
| 5,745,936 | A | 5/1998 | Van McCutcheon |

(Continued)

FOREIGN PATENT DOCUMENTS

| | | |
|---|---|---|
| GB | 2501526 | 10/2013 |
| JP | 2003116676 A | 4/2003 |

(Continued)

*Primary Examiner* — Nicholas F Polito
*Assistant Examiner* — Rahib T Zaman
(74) *Attorney, Agent, or Firm* — Guy Cumberbatch

(57) ABSTRACT

An easy-access bassinet especially useful for new mothers and babies, either in hospitals or at home. The bassinet has a barrier to prevent the infant from rolling off a sleeping platform, and one wall of the barrier is convertible to permit a mother to reach in and cradle the infant, for breast-feeding for example. The convertible wall may have a restoring mechanism to transform it back to its original barrier position upon removal of the weight of the mother's arms, or may be detachable. The convertible wall may be rigid adjacent the sleeping platform that lowers or pivots out of the way, or a mesh or fabric panel that may be depressed downward. A partial barrier wall may also be provided just inside the convertible front wall for extra security. The mesh or fabric panel is easily detached for cleaning or replacement.

16 Claims, 14 Drawing Sheets

(56) References Cited

U.S. PATENT DOCUMENTS

| | | | | |
|---|---|---|---|---|
| 5,819,340 | A | 12/1998 | Kelly | |
| 5,845,349 | A | 12/1998 | Tharalson | |
| 5,970,539 | A | 10/1999 | McDermott | |
| 6,148,456 | A | 11/2000 | Tharalson | |
| 6,155,970 | A * | 12/2000 | Dykes | A61G 11/00 5/610 |
| 6,360,384 | B1 | 3/2002 | Kuempel | |
| 6,453,490 | B1 * | 9/2002 | Cardinale | A47C 21/08 5/425 |
| 6,550,082 | B2 | 4/2003 | Tharalson | |
| 6,862,757 | B2 | 3/2005 | Andriunas | |
| 6,915,536 | B2 | 7/2005 | Chen | |
| 6,934,981 | B2 | 8/2005 | Waldman | |
| 7,013,505 | B2 | 3/2006 | Martin | |
| RE39,136 | E | 6/2006 | Tharalson | |
| 7,406,725 | B2 | 8/2008 | Martin | |
| 7,540,046 | B1 | 6/2009 | Lai | |
| 7,827,631 | B2 | 11/2010 | Holman | |
| 8,096,006 | B2 | 1/2012 | DeBraal | |
| 8,216,248 | B2 | 7/2012 | Brown | |
| 8,220,089 | B1 * | 7/2012 | Diefenbach | A47D 9/02 5/655 |
| 8,429,771 | B2 | 4/2013 | Long | |
| 8,745,780 | B2 | 6/2014 | Su | |
| 8,844,071 | B1 * | 9/2014 | Alexander | A47D 11/007 5/1 |
| 9,038,638 | B1 | 5/2015 | Cabrera | |
| 9,226,594 | B2 | 1/2016 | Long | |
| 2005/0246835 | A1 | 11/2005 | Tu | |
| 2005/0262628 | A1 | 12/2005 | Tharalson | |
| 2006/0000017 | A1 | 1/2006 | Hernandez | |
| 2007/0056109 | A1 | 3/2007 | Forshpan | |
| 2008/0141457 | A1 | 6/2008 | Forshpan | |
| 2008/0222810 | A1 | 9/2008 | Epshetsky | |
| 2010/0199426 | A1 * | 8/2010 | Long | A47D 7/04 5/100 |
| 2010/0263121 | A1 | 10/2010 | Arnold | |
| 2013/0145546 | A1 | 6/2013 | Cheng | |
| 2013/0185867 | A1 * | 7/2013 | Long | A47D 7/04 5/95 |

FOREIGN PATENT DOCUMENTS

| | | |
|---|---|---|
| KR | 200418800 Y1 | 6/2006 |
| WO | WO2013164616 | 11/2013 |

* cited by examiner 184
186

184

170
170
188

FLEXIBLE WALL SAFETY BASSINET

RELATED APPLICATIONS

The present application claims priority under 35 U.S.C. § 119(e) to U.S. Provisional Application No. 62/152,591, filed Apr. 24, 2015 under the same title, the contents of which are expressly incorporated herein.

FIELD OF THE INVENTION

This invention relates generally to bassinets and, more particularly, to a bassinet that enables a mother to easily access an infant therein, provides a safety feature to prevent the infant from falling out, and is easy to clean.

BACKGROUND OF THE INVENTION

The American Academy of Pediatrics states that the risks of co-bedding with a newborn, outweighs the benefits, and therefore, a mother should co-sleep (have the newborn at close proximity, but on a separate sleeping surface), and NOT co-bed with their newborn.

While most mothers will choose not to sleep in bed with their newborn, many fall asleep while they are feeding their infant. Further, even if the mother does not unintentionally fall asleep, when she tries to transfer her newborn to a separate surface after feeding, the newborn will awake and start to fuss or cry.

Many mothers still choose to sleep in bed with their newborns (bed sharing or co-bedding). There is research supporting a mother co-bedding with her newborn, stating that the mother is cued in to her newborn's movements, and will awaken if her newborn stirs or moves while in the mother's bed. In fact, most mothers who sleep with their infants will awaken when the infant starts to stir. Also, research has shown that the newborn benefits in many ways being in close proximity to its mother. The problem is that mothers are totally exhausted from waking every few hours to feed their newborn, and thousands of mothers have unintentionally suffocated their newborns by accidentally laying on top of them and obstructing their airway. Even though most mothers awaken and move away from the newborn, they are still suffering from never going in to a deep sleep for months, and the sleep deprivation can lead to anxiety and depression.

In an effort to improve outcomes for mothers and infants, a bassinet designed for a mother's comfort and the baby's safety, and which is relatively simple and cost-effective, is needed.

SUMMARY OF THE INVENTION

One aspect of the present application is a bassinet having a lower frame adapted to support a sleeping platform for a baby. A plurality of barrier walls mounted around a periphery of the lower frame present a complete barrier to a baby rolling off the sleeping platform when in a raised configuration. At least one of the barrier walls is a convertible wall configured to move from a raised position to a lowered position at or below the level of the sleeping platform. A partial barrier wall is positioned adjacent to and just inside the convertible wall, the partial barrier wall being shorter than the convertible wall and formed with gentle curves and no sharp edges. The bassinet may have a stand that supports the lower frame in a cantilevered manner so that the bassinet may be positioned over a bed.

Desirably, the partial barrier wall is padded. The enclosure walls define a generally rectangular shape for the bassinet having a length and a width, and the partial barrier wall has a length of between about 20-35% of the length of the bassinet. In one embodiment the partial barrier wall has a convex curved upper edge that curves down to the level of the sleeping platform, and may be arch-shaped with a lower opening.

On one aspect, the plurality of enclosure walls comprise a rigid rear wall and a pair of rigid abbreviated end walls which extend forward from the rear wall about half of a width dimension of the bassinet. A front wall is the convertible wall and is pivotally connected at opposite ends to the abbreviated end walls, the front wall extending about half of the width dimension of the bassinet on ends thereof and along a front length dimension. The front wall may include a pair of U-shaped bars, a lower bar and an upper bar, wherein the upper bar is pivotally connected at opposite ends to the abbreviated end walls. A flexible fabric panel is secured to both the lower and upper bars so as to form a part of the complete barrier to a baby rolling off the sleeping platform when the upper bar is in a raised configuration. Preferably, both upper and lower bars are detachable from the abbreviated end walls and the flexible fabric panel includes elongated horizontal sleeves on top and bottom edges that received the upper and lower bars, respectively, the flexible fabric panel thus being removable for washing or replacement.

In another aspect, the plurality of enclosure walls comprise a rigid rear wall and a pair of rigid end walls which extend forward from the rear wall along a width dimension of the bassinet. A front wall is the convertible wall and is pivotally connected at opposite ends to the lower frame at front corners of the end walls to be moved from the raised position to the lowered position. Furthermore, a flexible fabric panel may be removably secured vertically within the bassinet just inside the front wall in its raised position, wherein an upper elastic edge of the flexible fabric panel may be lowered to a position at or below the level of the sleeping platform.

A second exemplary bassinet disclosed herein also has a lower frame adapted to support a sleeping platform for a baby. A plurality of enclosure walls mount around a periphery of the lower frame and present a complete barrier to a baby rolling off the sleeping platform. At least one of the enclosure walls is a flexible fabric panel that may be lowered to a position at or below the level of the sleeping platform, the flexible fabric panel being easily removable from the bassinet for cleaning or replacement. Again, a stand may be provided that supports the lower frame in a cantilevered manner so that the bassinet may be positioned over a bed.

The second exemplary bassinet may further include a partial barrier wall positioned adjacent to and adjacent the flexible fabric panel, the partial barrier wall being shorter than the flexible fabric panel and formed with gentle curves and no sharp edges, the partial barrier wall having a length of between about 20-35% of the length of the bassinet. Desirably, the partial barrier wall has a convex curved upper edge that curves down to the level of the sleeping platform.

In the second exemplary bassinet, the plurality of enclosure walls may comprise a rigid rear wall and a pair of rigid abbreviated end walls which extend forward from the rear wall about half of a width dimension of the bassinet, and a front wall pivotally connected at opposite ends to the abbreviated end walls. The front wall extends about half of the width dimension of the bassinet on ends thereof and along a front length dimension, wherein the flexible fabric panel extends around the entire front wall. In this embodiment, the front wall may include a pair of U-shaped bars, a lower bar and an upper bar, wherein the upper bar is pivotally connected at opposite ends to the abbreviated end walls, and wherein the flexible fabric panel is secured to both the lower and upper bars. Both upper and lower bars may be detachable from the abbreviated end walls and the flexible fabric panel includes elongated sleeves on top and bottom edges that received the upper and lower bars.

Alternatively in the second exemplary bassinet, the plurality of enclosure walls comprise a rigid rear wall and a pair of rigid end walls which extend forward from the rear wall along a width dimension of the bassinet. A front wall is pivotally connected at opposite ends to the lower frame at front corners of the end walls to be moved from a raised position to a lowered position. The flexible fabric panel is removably secured vertically within the bassinet just inside the front wall in its raised position, wherein an upper elastic edge of the flexible fabric panel may be lowered to a position at or below the level of the sleeping platform.

Desirably, the flexible fabric panel is removably secured vertically within the bassinet along a front side thereof, wherein an upper elastic edge of the flexible fabric panel may be lowered to a position at or below the level of the sleeping platform.

In general, the present application provides a bassinet that keeps the newborn safe, should the mother unintentionally fall asleep while breast feeding her baby. This design would be particularly helpful for night feedings, as mothers are particularly susceptible to falling asleep unintentionally during this time.

The following features are preferably included in the bassinet:

1. A sleigh shaped bassinet with two clear plastic side walls that are able to be manually lowered, and pushed under and flush with the floor of the bassinet.

2. Two side walls made of a mesh fabric, that can be pressed down by means of an elastic band at the top of the side wall, and when not pressed on, returns to 3. A sturdy, vertical, hill shaped barrier fixed to the center of the side wall, providing a fixed partial barrier, designed to prevent the newborn from rolling off its mattress and out of the bassinet.

In one embodiment, a sleigh-shaped bassinet basket made of plastic, or metal, or wood, has a floor connected to a vertical headboard and foot board, leaving the 2 sides of the bassinet open. A 4 to 6 inch vertical partition, attached to the side walls in the center of the side wall providing a barrier between the mother and the newborn: its purpose to prevent the newborn from rolling off of the bed when the side wall is down. The partition would be removable or fixed to the center of the floor of the bassinet so that it is a partial barrier, still allowing the mother an unobstructed entry to place her arms inside the bassinet on either side of the barrier. The mother's arms will then be able to rest on both sides of the newborn's mattress, allowing her easy access to change or feed her newborn, while having the newborn and her arms supported by the floor of the bassinet. To accomplish this, the bassinet basket would be attached to a base, that allows the mother to bring the basket right next to her whether she is in a sitting or lying down position when in her bed or in a chair.

Another aspect disclosed herein is a bassinet with two side walls designed of a mesh fabric that, when secured to the headboard and footboard of the bassinet allows someone to press the wall down to the floor of the bassinet by means of elasticity, and when released, springs back to its original vertical placement. The mesh walls are designed to fit securely to the sides of the bassinet, and can be removed for cleaning. The side walls may be attached to a sleeve that fits snugly over the entire shell of the bassinet, by means of a fabric sleeve, that would be secured under the floor of the bassinet, by Velcro, or Snaps or hooks or elastic or anything that will keep the mesh side walls in place. The mesh wall could also be a mesh fabric that is fixed around the headboard and footboard of the bassinet by means of something such as snaps or elastic straps, or anything that would hold the mesh side walls securely to the headboard and footboard and be secured to remain in an upright vertical position if not being pushed down by the person attending the newborn. The mesh sleeve and the mesh side walls will be able to be washed and reused, or may be made of a disposable fabric, to be used in hospitals to prevent transferring of infection from one newborn to the next.

BRIEF DESCRIPTION OF THE DRAWINGS

Features and advantages of the present invention will become appreciated as the same become better understood with reference to the specification, claims, and appended drawings wherein:

DETAILED DESCRIPTION OF THE PREFERRED EMBODIMENTS

Keeping the newborn on its own sleeping surface while the mother breast feeds, will also prevent the mother from having to transfer the newborn. A newborn easily awakens when moved from its mother's arms to a separate sleeping surface, so not having to transfer the sleeping newborn to another surface, provides an easier way for the mother to keep her newborn from being disturbed after a feeding. Also, should the mother fall asleep and moves her arms out of the bassinet, the mesh side wall will automatically spring back to its original upright position. If there is an outer plastic side wall that slides under the newborn's bed when not in use, that side wall may have a manual or an automatic return, depending on the manufacturer's preference.

The bassinet can be separate or can be attached to a stand that is parallel to the mother's bed. The bassinet should have the capacity to be placed onto or over the mother's mattress, bringing the newborn close to its mother to feed. Should the mother fall asleep, if she removes her arm from around the newborn's body, the newborn's bed stand may have the capacity to automatically slowly retract, thus returning the newborn's sleeping platform to its original position away from the sleeping mother. If the bassinet is not on a stand, it could be placed in the center of the mother's bed, away from the side, to prevent the bassinet from falling off of the bed.

Figure 1:
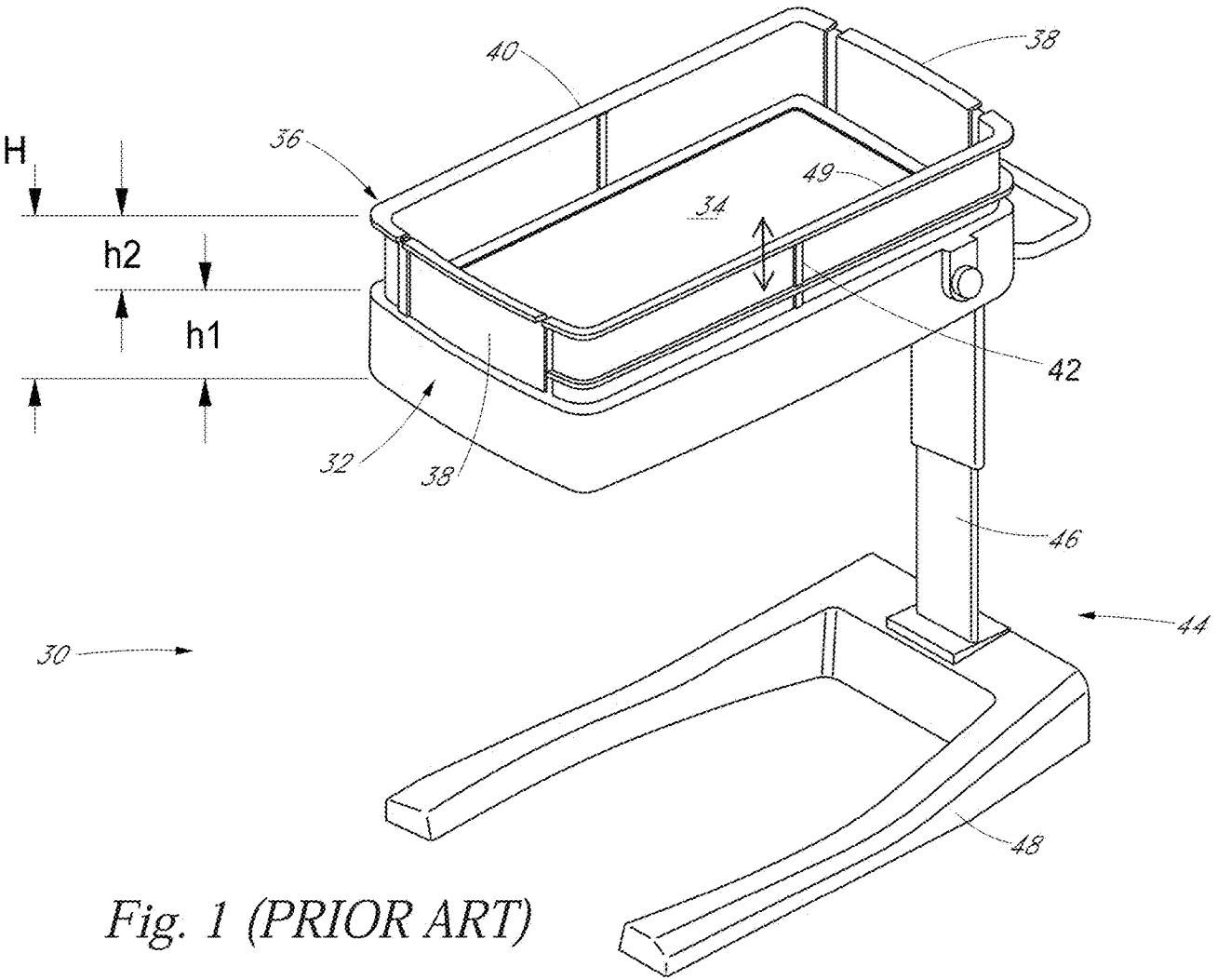
Fig. 1 (PRIOR ART)
FIG. 1 is a perspective view of an over-the-bed easy-access bassinet of the prior art which illustrates aspects of an over-the-bed stand for use with the bassinets disclosed herein.

FIG. 1 shows a bassinet 30 as disclosed in U.S. Pat. Nos. 8,429,771 and 9,226,594 to Long having a frame 32 on which is mounted a sleeping platform 34 surrounded by an upstanding enclosure 36. The enclosure 36 comprises end walls 38, a rear wall 40, and a front wall 42. In the illustrated embodiment the enclosure 36 defines a rounded rectangular shape with parallel end walls 38 being shorter in horizontal span than the parallel rear wall 40 and front wall 42. As will be described below, the front wall 42 converts between an elevated position presenting a barrier to an infant rolling off the sleeping platform 34 on that side and a lowered position in which the barrier is substantially removed. Although only the front wall 42 is shown as convertible, other walls or portions of the enclosure 36 may be convertible to increase the number of approaches for reaching in to the bassinet.

U.S. Pat. Nos. 8,429,771 and 9,226,594 to Long disclose a variety of different "easy-access" bassinets the details of which are expressly incorporated herein. The bassinets in Long are desirably mounted on an upright stand that is used to locate and support the bassinet over the mother's bed. In this respect, FIG. 1 illustrates an exemplary stand and is included to explain preferred aspects of such stands. The remaining drawings included herein do not show stands, but it should be understood that mounting the bassinets on an over-the-bed stand such as in FIG. 1 is a preferred configuration, and the absence of a stand in any drawing herein does not imply that that particular bassinet is not designed for such a support.

Referring back to FIG. 1, the frame 32 mounts on an upper end of a stand 44 having a support member 46 extending upward from a stabilizing base 48. The support member 46 may include structure to enable height adjustment, such as telescoped beams. Indeed, a power-assisted height-adjust mechanism, such as in hospital beds, may be included. The bassinet 30 can thus be raised or lowered to accommodate varying bed heights, and to assist nurses caring for the baby, such as allowing the nurse to lift the baby without having to bend over too far.

As mentioned, the bassinet 30 desirably describes a C-shape with the base 48 able to fit under a bed, while the frame 32 and sleeping platform 34 extend over the bed. That is, the stand 44 supports the lower frame 32 in a cantilevered manner so that the bassinet 30 may be positioned over a bed. In this regard, the base 48 can be raised and lowered to accommodate different bed heights. It should be noted, however, that certain features of the convertible enclosure may be suitable for other configurations of over-the-bed bassinets, and even for bassinets that are not designed to go over a bed.

The front wall 42 in the embodiment of FIG. 1 converts between its elevated and lowered positions by vertical displacement relative to the frame 32. That is, the front wall 42 maintains a generally vertical orientation and slides downward relative to the frame 32 and to the adjacent end walls 38. In one embodiment, the front wall 42 slides downward into the frame 32 to conceal its moving parts. For instance, the total height H of the frame 32 and enclosure 36 may be approximately twice the heights h1, h2 of the frame and enclosure, respectively. A space or cavity within the frame 32 receives and conceals the front wall 42 as it descends (not shown). Various structures to enable this particular sliding mechanism are described in U.S. Pat. Nos. 8,429,771 and 9,226,594 to Long.

In use, a mother lying on a bed may reach over the enclosure to cradle the baby, at the same time resting her arms on the front wall 42 which descends into the frame 32. The lowered position of the front wall 42 coincides with an upper edge 49 thereof being approximately at the level of the sleeping platform 34, or a mattress placed thereon. This removes the peripheral barrier from around the sleeping platform 34 and the mother's arms can rest comfortably over the lowered front wall 42 which is preferably rounded to eliminate sharp corners. The baby remains on the sleeping platform 34. This configuration is particularly comfortable for an extended period of breast-feeding, for example. The front wall 42 is also desirably mounted in the bassinet 30 with a restoring mechanism such as a spring that causes it to automatically return toward the elevated position from the lowered position in the absence of an external force or barrier, such as the mother's arms draped over the wall. When the mother desires to place the sleeping baby back into the enclosure 36, or if she happens to doze off while breast-feeding, the baby remains on the sleeping platform 34 and removal or relaxation of the mother's arms removes a downward force on the front wall 42, which permits it to return toward its elevated position.

Although U.S. Pat. Nos. 8,429,771 and 9,226,594 to Long describe numerous convertible bassinets, the opportunity remains for more comfortable and easier to clean bassinets, as will described below. Nevertheless, certain aspects described herein may be incorporated into the bassinet designs disclosed in the patents to Long, and thus, again, the disclosures in U.S. Pat. Nos. 8,429,771 and 9,226,594 are expressly incorporated herein.

One very useful aspect of the bassinets disclosed herein is at least one mesh wall that serves as the convertible wall. Such a mesh wall may include an elastic top edge that can easily be pushed down by the mother to reach in to care for the newborn. Further, the mesh wall may be removable so that it can be taken off and washed after a period of use. Additionally, a supplemental partial wall is desirably included within the bassinet and behind the convertible wall. The partial wall is intended to remain in place while the mother cares for or feeds the baby to provide a constant barrier to the baby rolling out of the bassinet when the convertible wall is down. Specific embodiments of these aspects are shown and described below.

Figure 2:
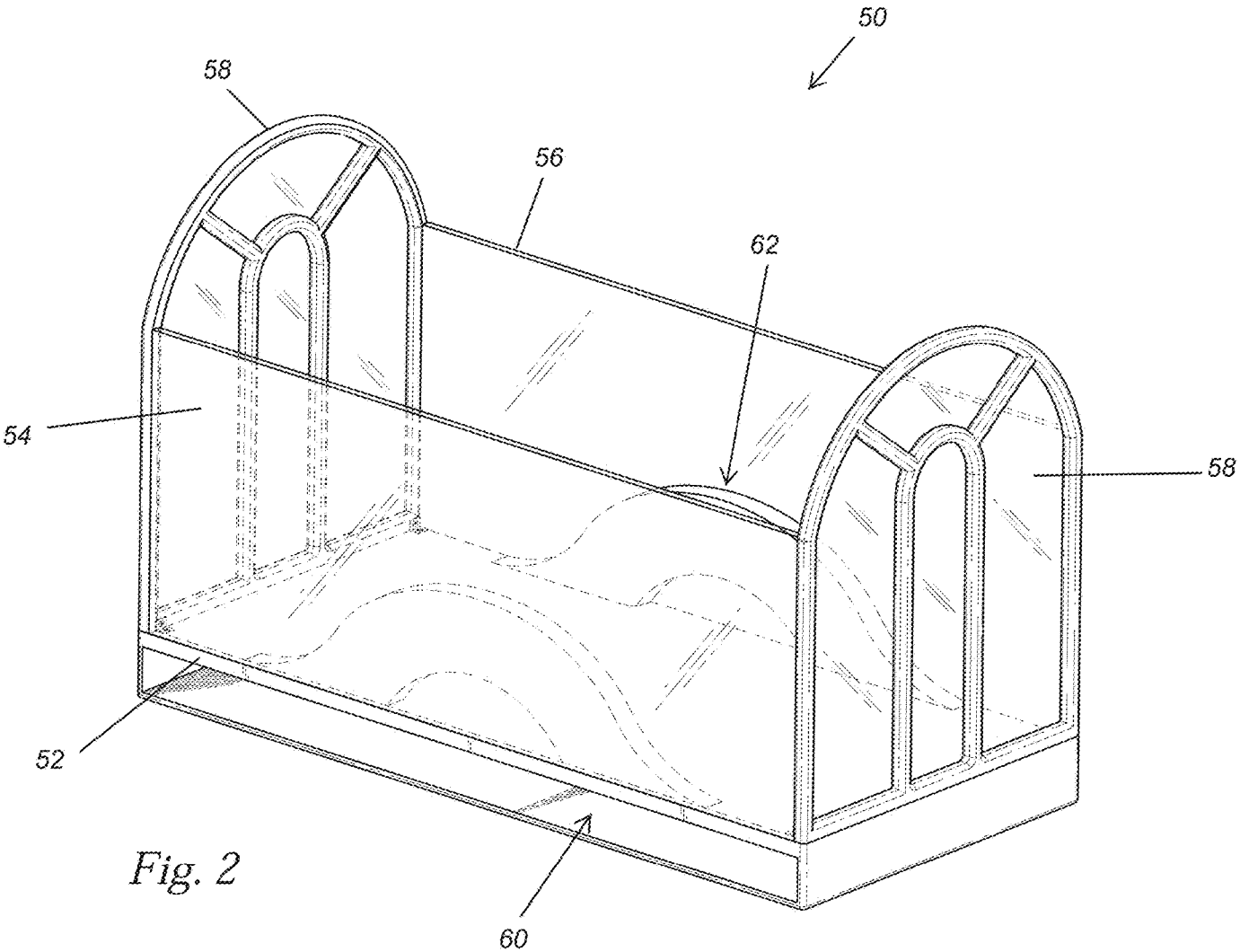
FIG. 2 is a perspective view of an exemplary over-the-bed easy-access bassinet of the present application.
Figure 2A:
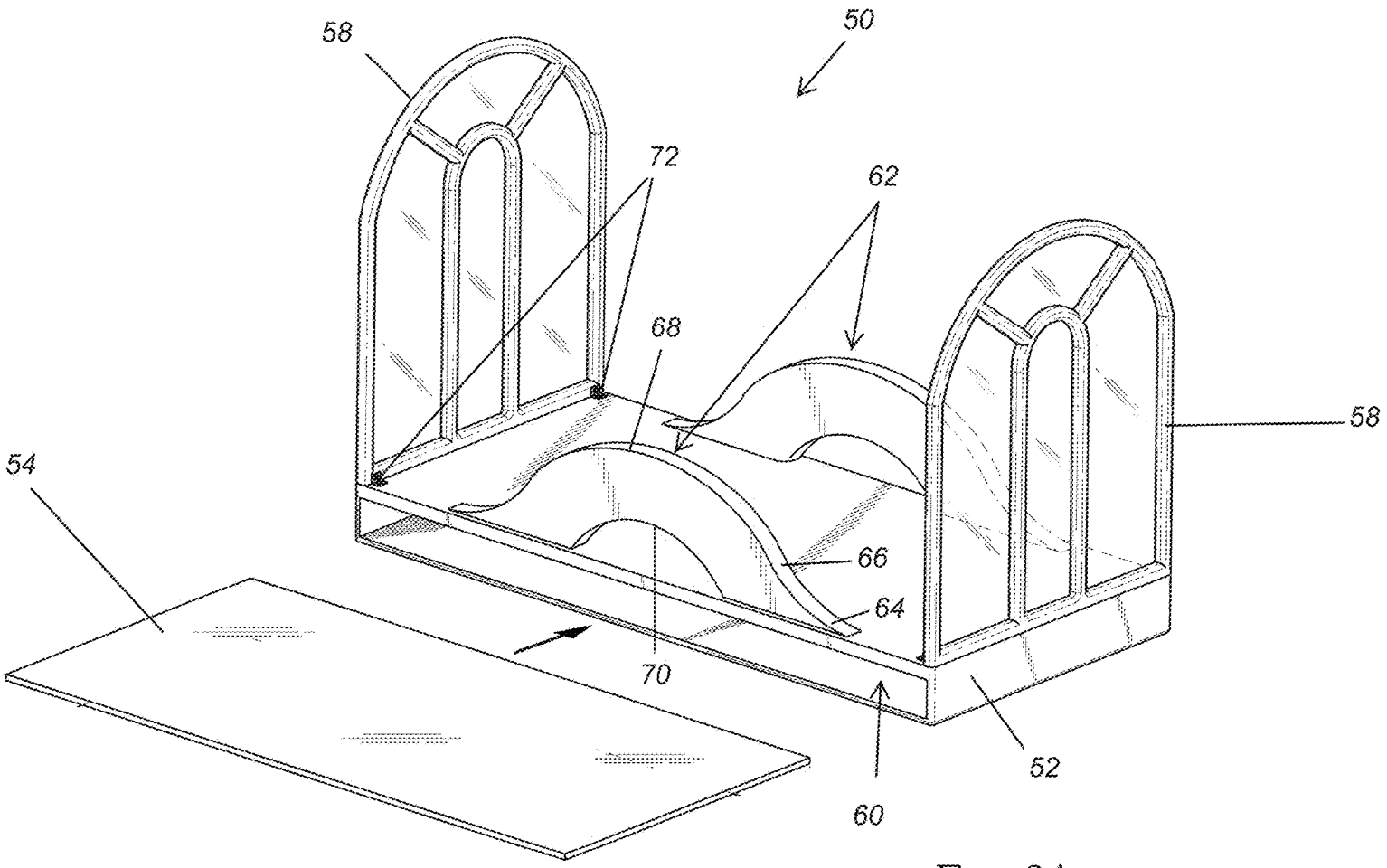
FIG. 2A is an exploded perspective view of the bassinet of FIG. 2.

FIG. 2 is a perspective view of an exemplary over-the-bed easy-access bassinet 50 of the present application, and FIG. 2A is an exploded perspective view thereof. The bassinet 50 includes a lower frame 52 defining a support surface for a mattress or other such bed for the baby (not shown). As mentioned above, the lower frame 52 may be supported on a stand for over-the-bed use, or the bassinet 50 may be a standalone, portable item. The bassinet 50 defines a sleigh-shaped enclosure for the baby including a front wall 54, a rear wall 56, and two end walls 58. That is, the walls 54, 56, 58 define the enclosure. At least one of the front wall 54 and rear wall 56 is desirably convertible between its upright orientation shown in FIG. 2 that provides a barrier to a sleeping baby within the bassinet, and a lowered configuration which removes the barrier and permits someone to reach in and care for the baby. It should be understood that the front wall 54 and/or rear wall 56 may be convertible in this respect in any of the embodiments disclosed in U.S. Pat. Nos. 8,429,771 and 9,226,594.

In one embodiment, shown in FIG. 2A, the front wall 54 is detachable from the front side of the bassinet 50 and may be slotted into a lower receptacle 60 formed in the frame 52. FIG. 2A shows both the front wall 54 and the rear wall 56 removed in this manner. For example, the front wall 54 may have Velcro strips or patches thereon which matchup with oppositely-configured Velcro strips or patches provided on the front edges of the end walls 58. Likewise, snaps, buttons, and the like may be used. Alternatively, the front wall 54 may be hinged to the horizontal front edge of the frame 52 so that it can be pivoted downward to remove the barrier on that side.

FIG. 2A shows both the front wall 54 and the rear wall 56 lowered so that they do not present a barrier to reaching into the bassinet, but a pair of smoothly contoured partial walls 62 remain in place. Both of these partial walls 62 are mounted just inside and parallel to the respective front and rear walls 54, 56, and are fixed in an upright orientation so as to present a barrier to the baby rolling out of the bassinet. At the same time, the mother or other caregiver can reach in on both ends of the partial walls 62 to care for the baby. That is, there are spaces between both ends of the partial wall 62 and the end walls 58 where there is no barrier and a person's arms can be rested. In one embodiment, the partial walls 62 have a length of approximately 4 to 6 inches, while the entire length of the bassinet 50 is between 25-30 inches.

In the illustrated embodiment, the partial wall 62 comprise gently curving upward arcs that began at relatively flat ends 64 curving upward in a concave manner before reaching inflection points 66 defining the beginnings of a convex upper edge 68. The partial walls 62 are desirably formed of a relatively rigid material such as a plastic covered with padding to be comfortable to the baby and the caregiver. The partial walls 62 may be firmly mounted in place so as to be non-removable, or may be detachable though capable of providing a firm barrier to keep the baby and the bassinet. For example, lower tabs (not shown) may be inserted into the frame 52 to provide the rigidity and detachability. The partial walls 62 may be formed in an arch shape as shown with a lower opening 70 to facilitate removal.

The end walls 58 may also be convertible, with hinges 72 provided at their lower edges so that they may be pivoted outward for better access to the interior of the bassinet 50. Alternatively, the hinges 72 may enable inward pivoting to collapse the bassinet for greater portability or a smaller storage profile.

Figure 3:
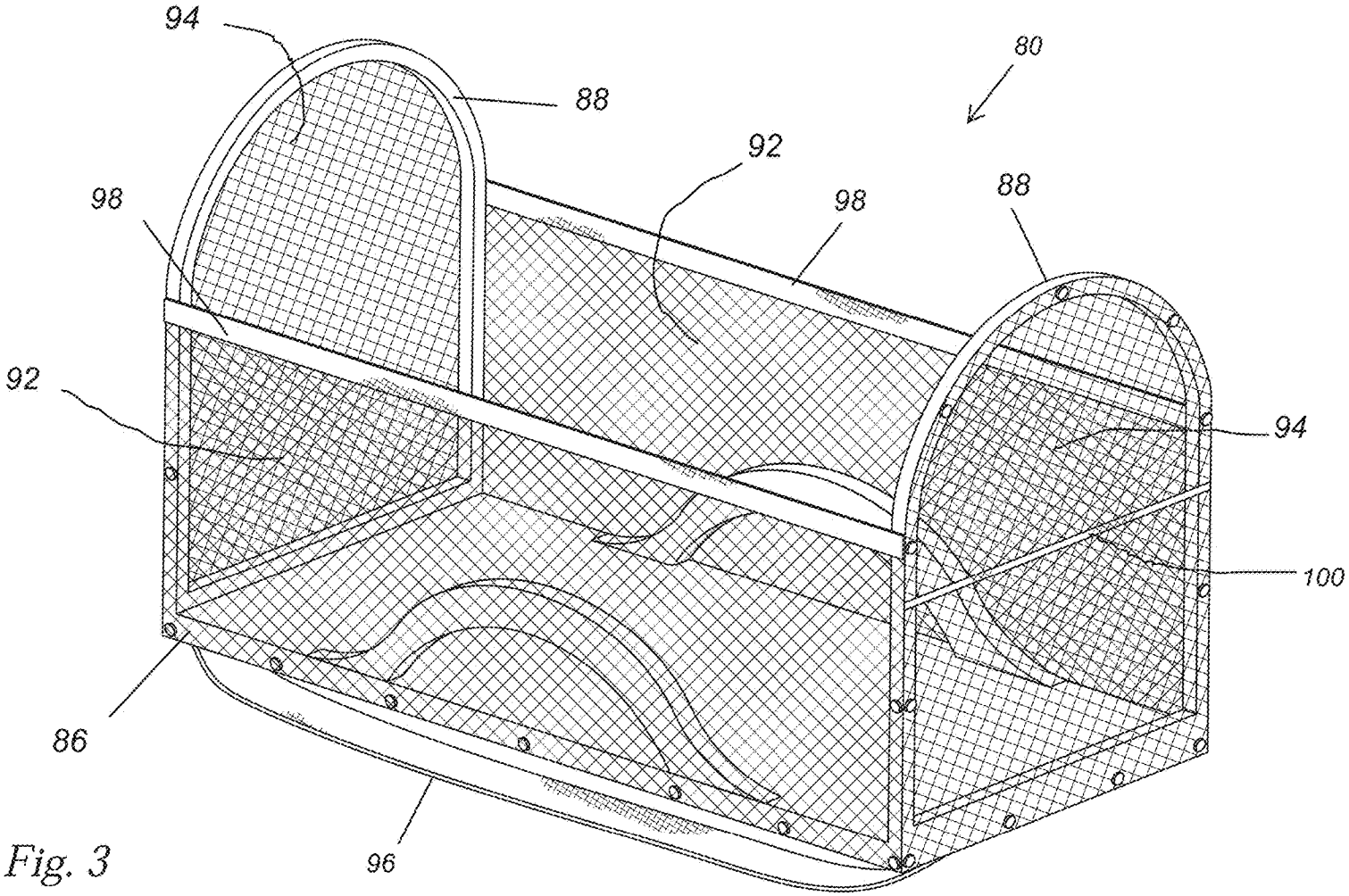
FIG. 3 is a perspective view of an alternative over-the-bed easy-access bassinet of the present application.
Figure 3A:
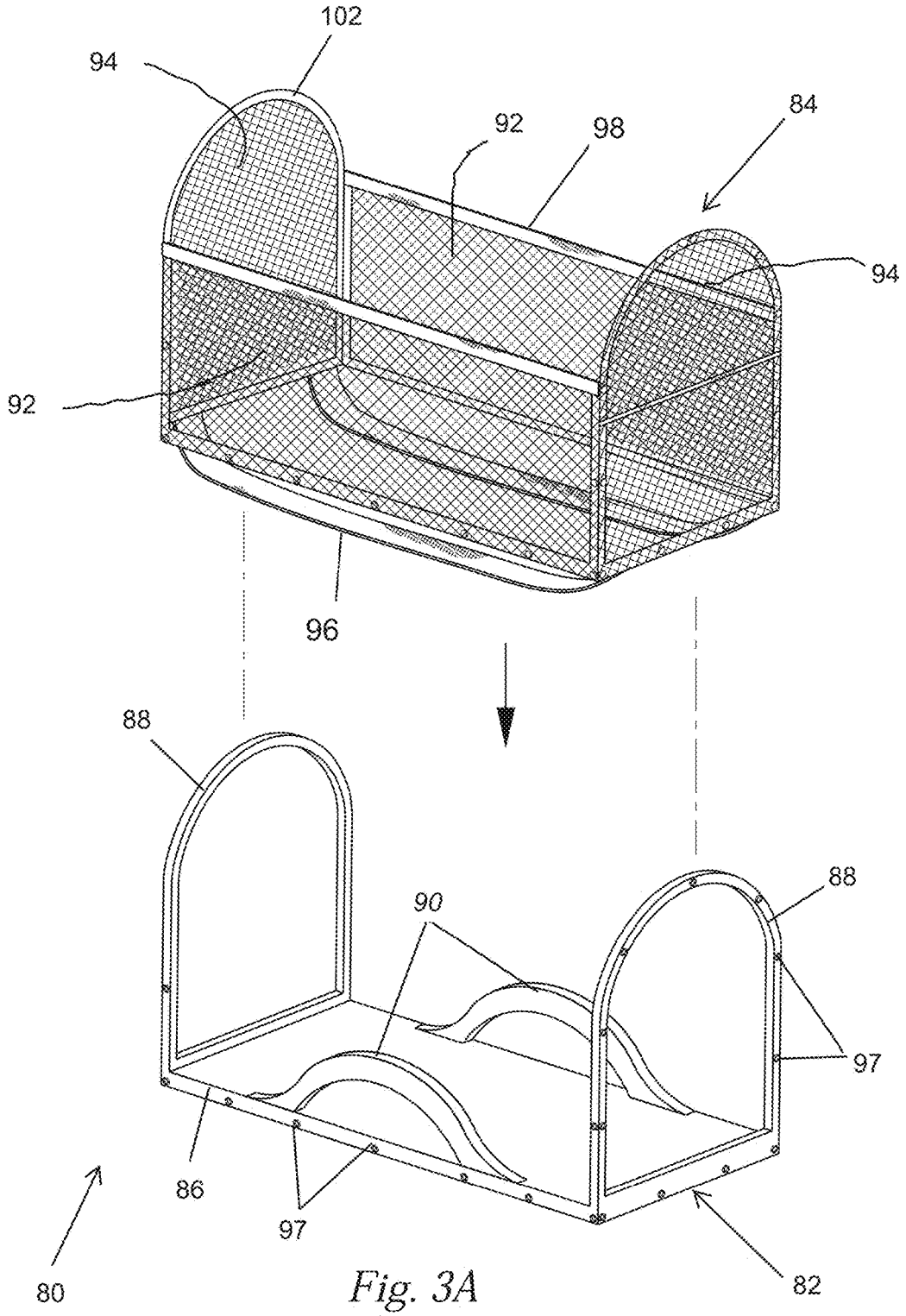
FIG. 3A is an exploded perspective view of the bassinet of FIG. 3.

FIG. 3 is a perspective view of an alternative over-the-bed easy-access bassinet 80 of the present application, while FIG. 3A is an exploded perspective view thereof. As best seen in FIG. 3A, the generally sleigh-shaped bassinet 80 primarily comprises a relatively rigid frame 82 and a flexible mesh cover 84. The frame 82 includes a horizontal lower frame member 86 on which a mattress or other bed for the baby is mounted, a pair of upstanding end walls 88, and a pair of partial barrier walls 90 much like those described above. The end walls 88 are desirably simple arches that extend upward from the lower frame member 86 in a generally semi-circular fashion.

The mesh cover 84 has a generally rectangular profile with a pair of front or rear panels 92, end panels 94, and a pair of lower straps 96 for securing the cover onto the frame 82. (Because of the symmetry of the mesh cover 84, the orientation of front or rear merely depends on which side of the bassinet 80 is facing the mother.) The cover 84 has an open bottom and a rectangular size which fits closely around the outside of the frame 82 like a sleeve. A plurality of snaps, Velcro, or other such fasteners 97 are desirably provided on the exterior of the frame 82 such as on the front and rear edges of the lower frame member 86 and on the sides and outer edges of the end walls 88. Mating fasteners are provided on interior surfaces of the mesh cover 84 to enable the cover to be snugly fitted around the frame. The lower straps 96 further provide a securement between the cover 84 and frame 82.

When the cover 84 is secured onto the frame 82, such as shown in FIG. 3, the combination of the end walls 88 and cover provide an enclosure all the way around the interior of the bassinet, thus preventing a baby from falling out. Upper edges 98 of the front and/or rear panels 92 are desirably elastic to enable a mother or caregiver to easily depress that panel and reach in for providing care to the baby. For example, one of the panels 92 may be completely depressed so that the upper edge 98 lies flush against the bed (not shown) resting on the lower frame member 86 so that the mother can cradle the baby and lift him or her out of the bassinet. Even when one or the other of the panels 92 is depressed in this manner, the partial barrier walls 90 maintain an impediment on that side to prevent the baby from rolling out. Preferably, the partial walls 90 have a length of approximately 6-8 inches and a height of 4-6 inches, while the entire length of the bassinet 80 is between 25-30 inches. In general, the partial walls 90 have a length of between about 20-35% of the length of the bassinet. Furthermore, the elastic upper edges 98 of the panels 92 provide an automatic return force to that panel so that if the mother falls asleep the barrier on that side converts back to its upright configuration.

In an alternative embodiment, a part or all of the lower edges of the panels 92 may be unsnapped (or un-Velcroed) from attachment with the lower frame member 86 so that the mother can lift the edge up to access the baby. Preferably the lower edge is also elastic. That is, when the mother is lying on her side on the bed facing the newborn, she can lift the closest mesh panel 92 and encircle the baby so that the newborn is now lying on its side facing the mother's breast and she can nurse the newborn in a side lying position. The partial barrier wall 90 on that side prevents the newborn from rolling off of its mattress onto the mother's bed, while the mother's arm is keeping the newborn facing the mother while she nurses. When the newborn finishes nursing, the mother removes her arm from inside the bassinet, the mesh panel 92 elastically lowers into position, and, with the mother's arm no longer encircling the baby, the baby returns to its supine position. The fasteners between the lower frame member 86 and the panel 92 can then be re-attached.

A dual layer of mesh material on one or both of the end panels 94 topped with a horizontal elastic band 100 may be provided so that a pocket is created on one or both ends of the bassinet. The pocket can then be used for storing toys or baby care supplies such as diapers.

Because the mesh cover 84 is completely removable from around the frame 82, it may be taken off and washed when it gets dirty. In a preferred embodiment, the mesh cover 84 comprises strips 102 of nylon or other such durable materials along its edges and corners to which a polyester mesh is sewn. The corner and edge strips provide placement for the aforementioned fasteners that engage the mating fasteners on the frame 82. In an alternative embodiment, the mesh material for the panels may be replaced with a more opaque fabric, however the mesh provides visibility of the baby within the bassinet from the side.

Figure 4:
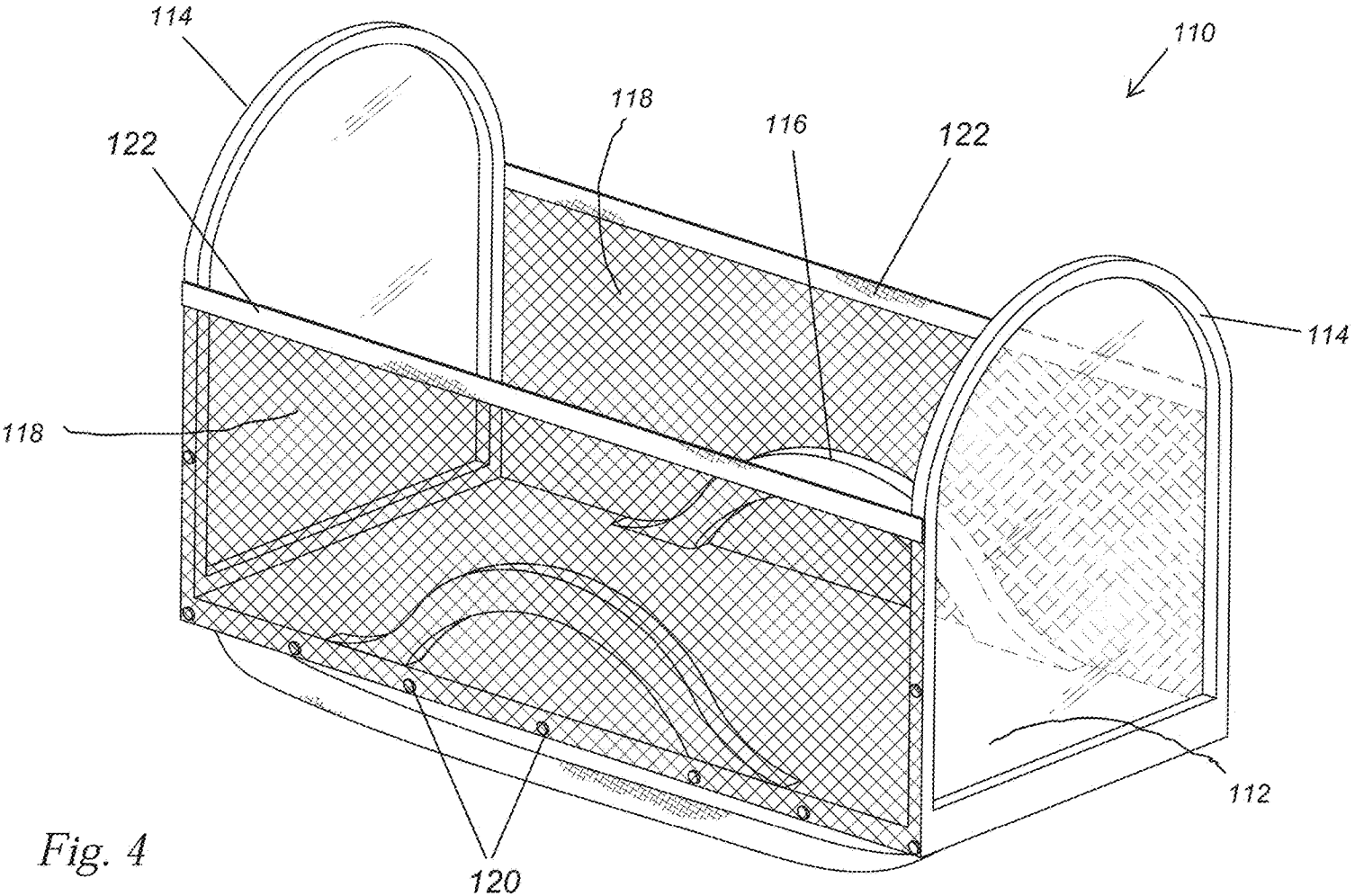
FIG. 4 is a perspective view of another alternative over-the-bed easy-access bassinet of the present application.

FIG. 4 is a perspective view of another over-the-bed easy-access bassinet 110 of the present application which is similar in configuration to that shown in FIGS. 3 and 3A. The bassinet 110 comprises a rigid frame formed by a lower frame member 112, a pair of upstanding end walls 114, and a pair of partial barrier members 116, as described before. Instead of the entire side panels being mesh or fabric, a pair of front or rear panels 118 are secured to opposite sides of the bassinet 110. Each of the panels 118 is rectangular and includes fasteners 120 thereon which mate with fasteners provided on the front and rear edges of both the lower frame member 112 and upstanding end walls 140. As before, an upper edge 122 of each of the panels 118 is an elastic material to enable that panel to be lowered when necessary. As described above, a lower edge may also be elastic so that the mother can lift up the panel 118 to access the bassinet enclosure. The end walls 114 provide solid barriers as opposed to just frame for a mesh, or may also be a mesh. The walls 114 and panels 118 define the enclosure for the bassinet 110.

Figure 5:
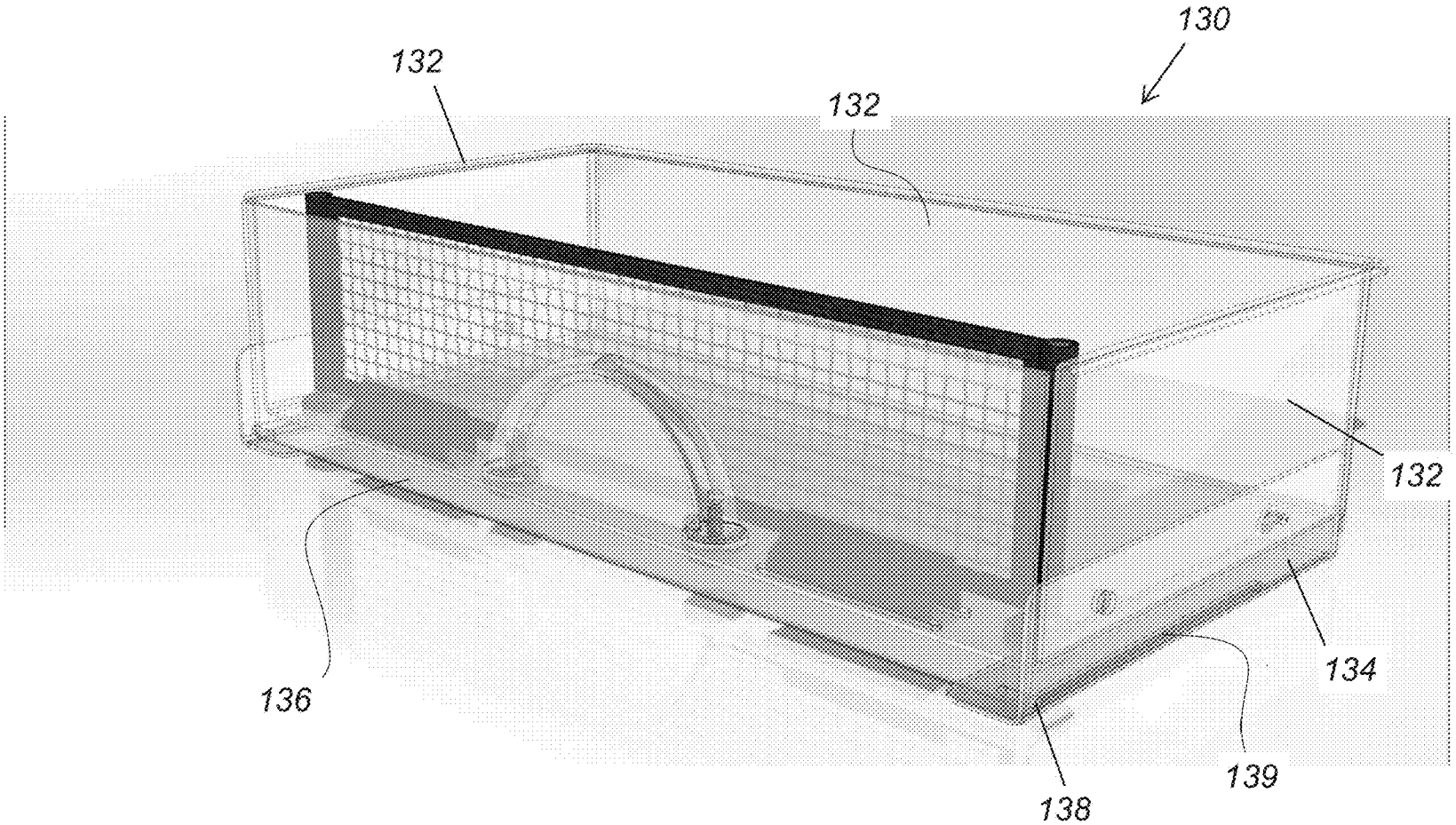
FIG. 5 is a perspective view of a further alternative over-the-bed easy-access bassinet of the present application.
Figure 5A:
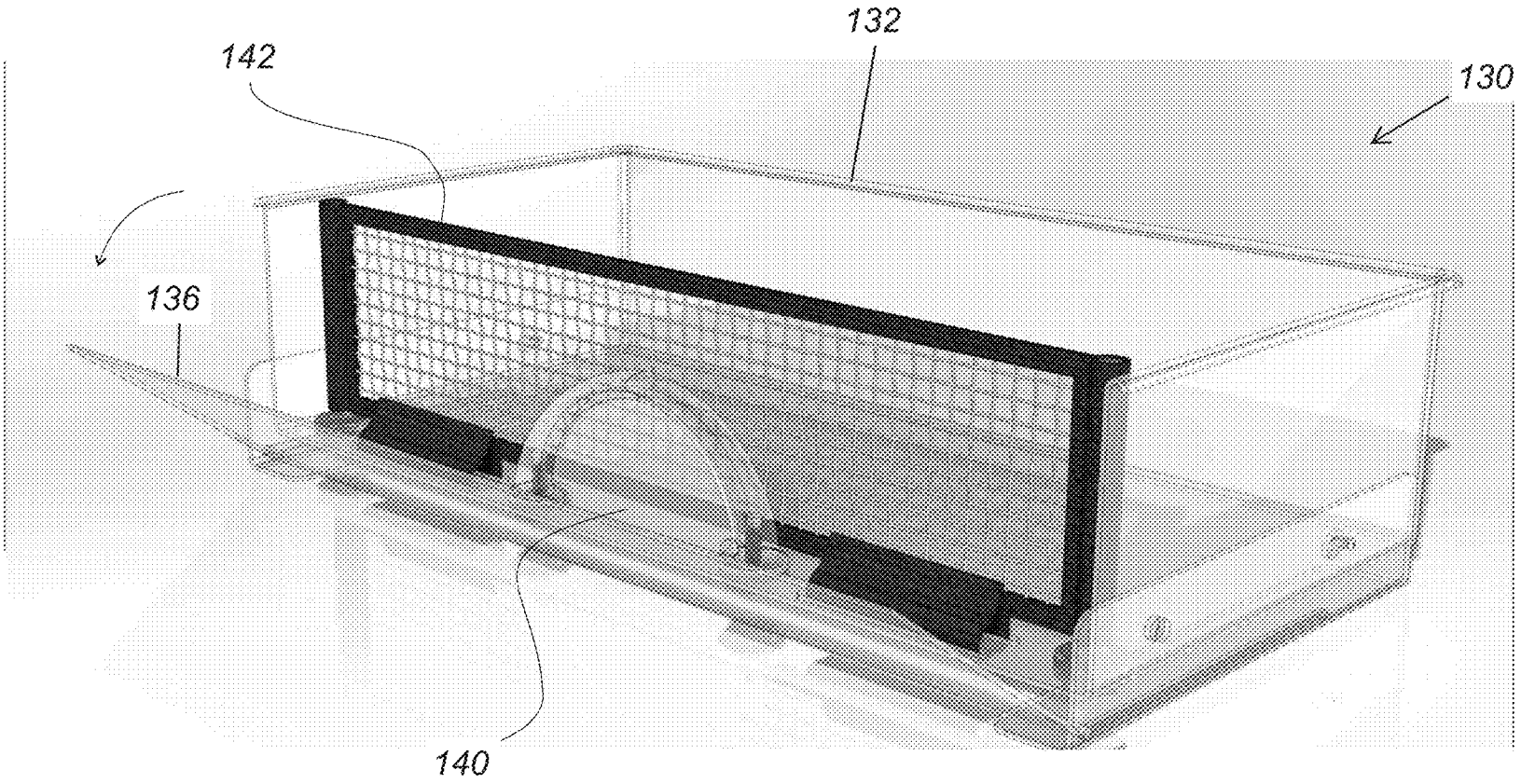
FIGS. 5A-5C are perspective views of the bassinet of FIG. 5 in several different configurations and showing a removable mesh panel.
Figure 5B:
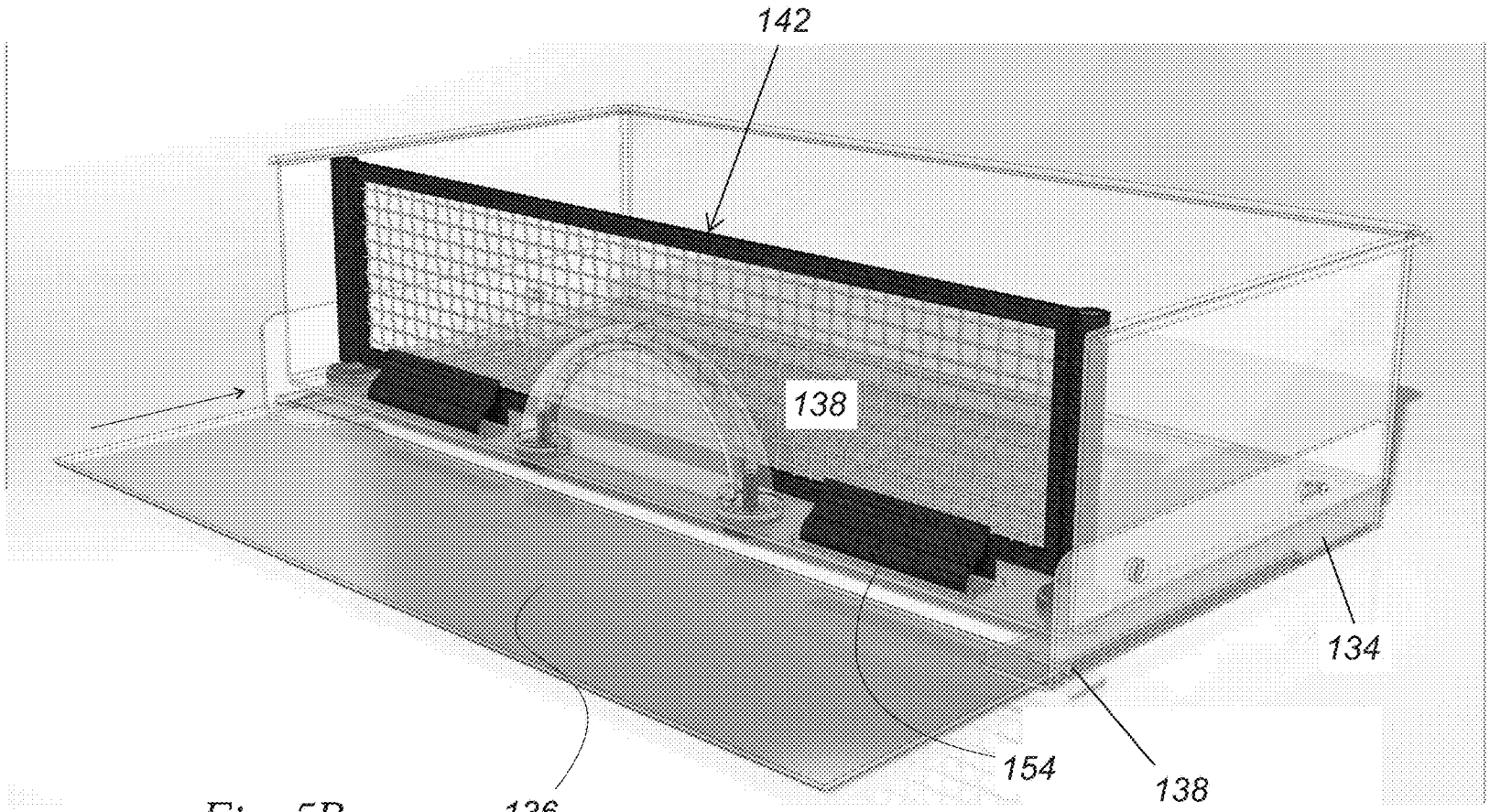
Figure 5C:
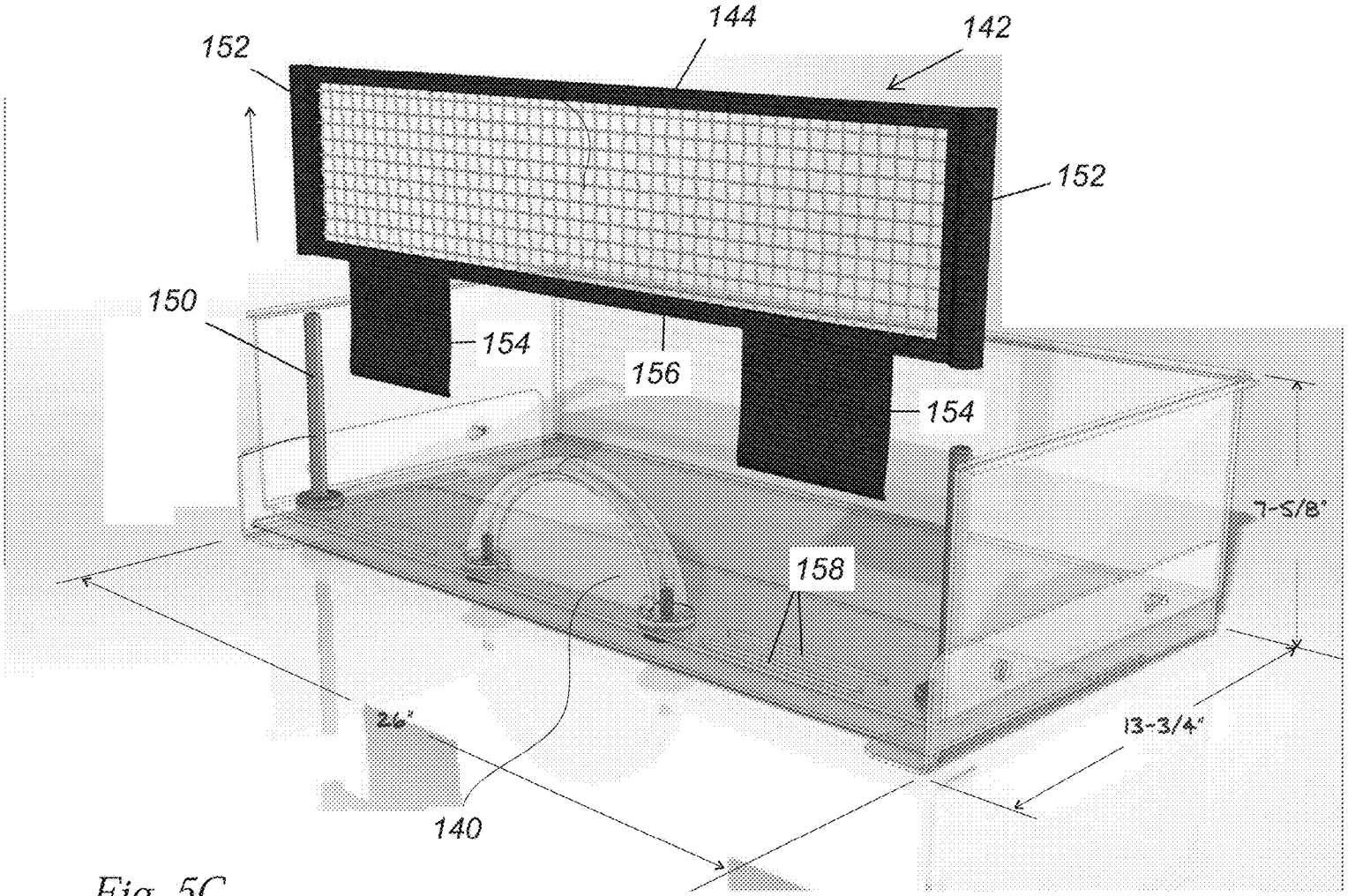

FIG. 5 is a perspective view of a further alternative over-the-bed easy-access bassinet 130 of the present application, and FIGS. 5A-5C are perspective views of the bassinet in several different configurations and showing a removable mesh panel. The bassinet 130 is somewhat similar to the bassinet 50 shown in FIGS. 2 and 2A in that there are a number of solid side walls 132 on three sides of a lower frame 134 defining a barrier to the baby falling out, with a front wall 136 being convertible to a lowered position. In one preferred embodiment, the three side walls 132 are formed of transparent plexiglass to enhance visibility within the bassinet. The walls 132, 136 define the enclosure for the baby.

The front wall 136 may also be formed of transparent plexiglass, and is hinged at lower corners 138 to the lower frame 134. As seen in FIGS. 5A and 5B, the front wall 136 may be pivoted outward and downward to lie horizontal and enable access to the interior of the bassinet. Additionally, the hinges 138 may be arranged along a slot 139 so that they enable sliding of the front wall 136 into a space within the lower frame 134 and underneath the mattress or other soft bedding within the bassinet.

In addition to the front wall 136, an upstanding partial barrier 140 is provided just within the bassinet 130 and adjacent the front wall. Therefore, even when the front wall 136 has been lowered, the baby still cannot easily rollout because of the impediment of the partial barrier 140. In a preferred embodiment, the partial barrier 140 comprises an arch-shaped solid wall that is detachably mounted to the lower frame 134. Although spaces remain between the partial barrier 140 and the end walls 132, it provides an effective impediment to the baby falling out. Again, the partial barrier 140 preferably has a length of approximately 6-8 inches and a height of 4-6 inches, while the entire length of the bassinet 130 is between 25-30 inches. Again, the partial barrier 140 has a length of between about 20-35% of the total length of the bassinet.

Furthermore, a removable mesh panel 142 may be secured adjacent the partial barrier 140. The mesh panel 142 desirably has an elastic upper edge 144 so that the mother can reach in and provide care to the baby. Indeed, the mother can either lift the baby out or breast-feed the baby while the baby remains in the bassinet by leaning in and pressing the mesh panel 142 downward.

FIG. 5C shows an exemplary construction of the removable mesh panel 142. A pair of vertical studs 150 are mounted on either end of the bassinet adjacent the front wall 136. Vertical edges 152 on either end of the mesh panel 142 include pockets that received the removable studs. The studs 150 may be removable so that the bassinet 130 can be used without the mesh panel 142. Additionally, a pair of flaps 154 extends downward from a lower edge 156 of the mesh panel 142. The flaps 154 may be secured to a pair of horizontal slots 158 provided in the lower frame 134. For example, the flaps 154 may have mating Velcro on opposite sides to enable the flaps to be looped around the horizontal slots 158 and secured to themselves. Once again, the ability to easily remove the mesh panel 142 enables easy cleaning or replacement. FIG. 5C also shows exemplary dimensions of the bassinet 130, which may be varied by up to 10%.

It should be noted here that the removable mesh or fabric panels described herein may be washable and reusable, such as being made of a polyester or other such durable fabric. Alternatively, disposable mesh or fabric panels may be used. Numerous hospital gowns and other such articles (e.g., slippers, shower caps, drapes, and the like) are fabricated from paper or other slightly more durable flexible materials such as plastic, and the mesh panels may also be inexpensively made in this manner so that they need only be replaced with a new one when dirty. The term, "flexible fabric panel" will be used to encompass various mesh and fabric options, both disposable and otherwise, paper, polymer, fibrous, or other base materials.

Figure 6:
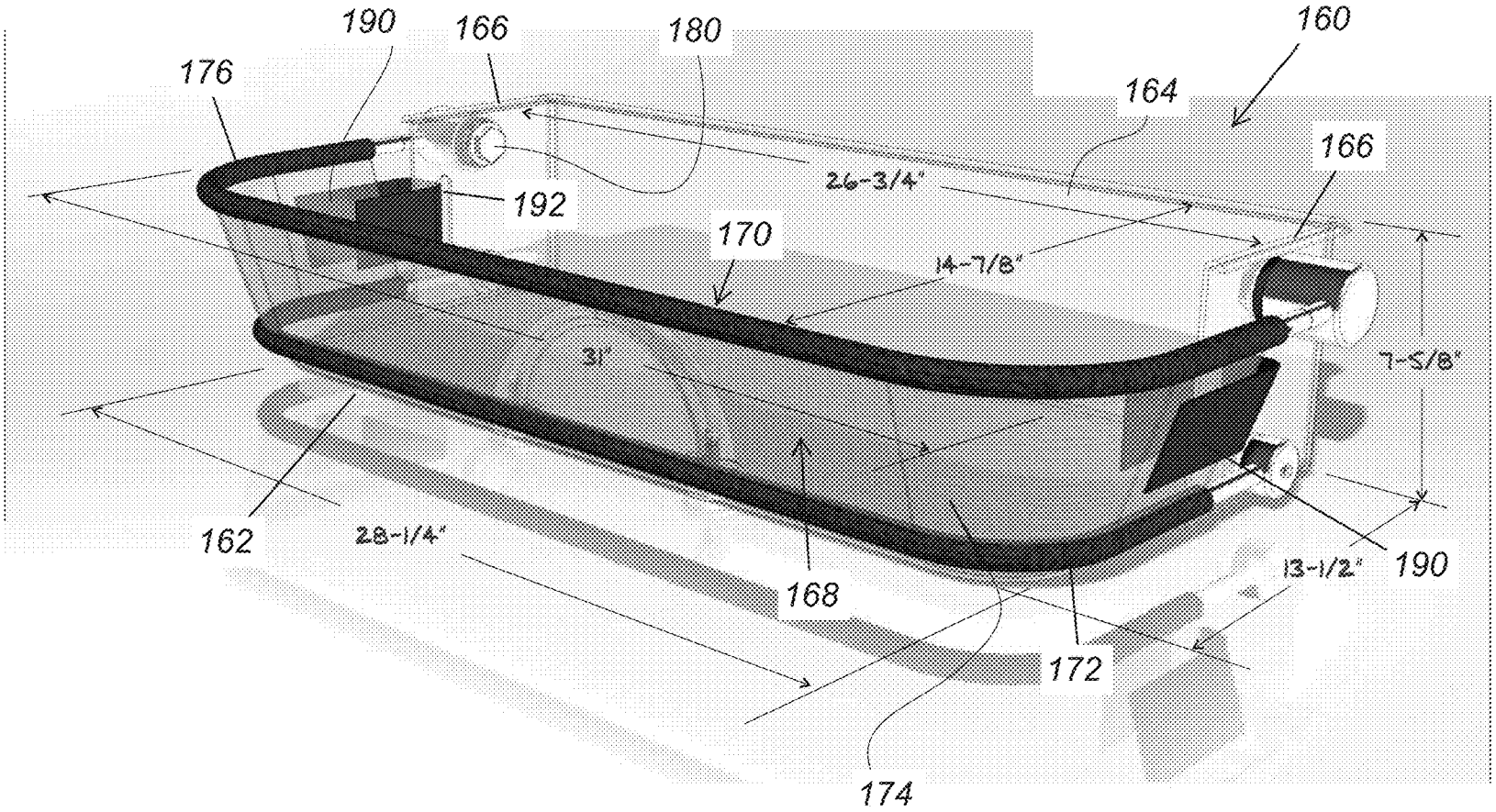
FIG. 6 is a perspective view of a further alternative over-the-bed easy-access bassinet of the present application.
Figure 6A:
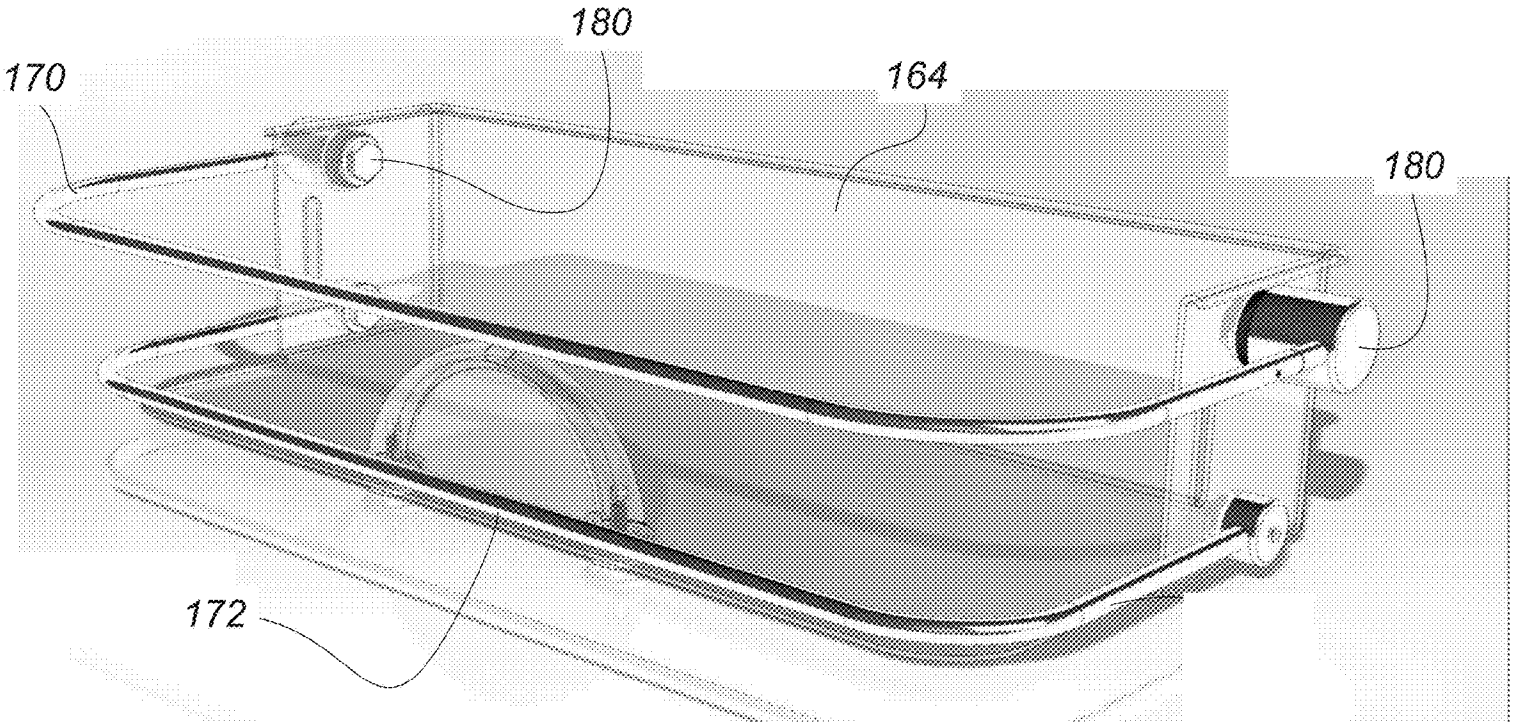
FIGS. 6A-6B are perspective views of the bassinet of FIG. 6 with a mesh panel removed in two different configurations.
Figure 6B:
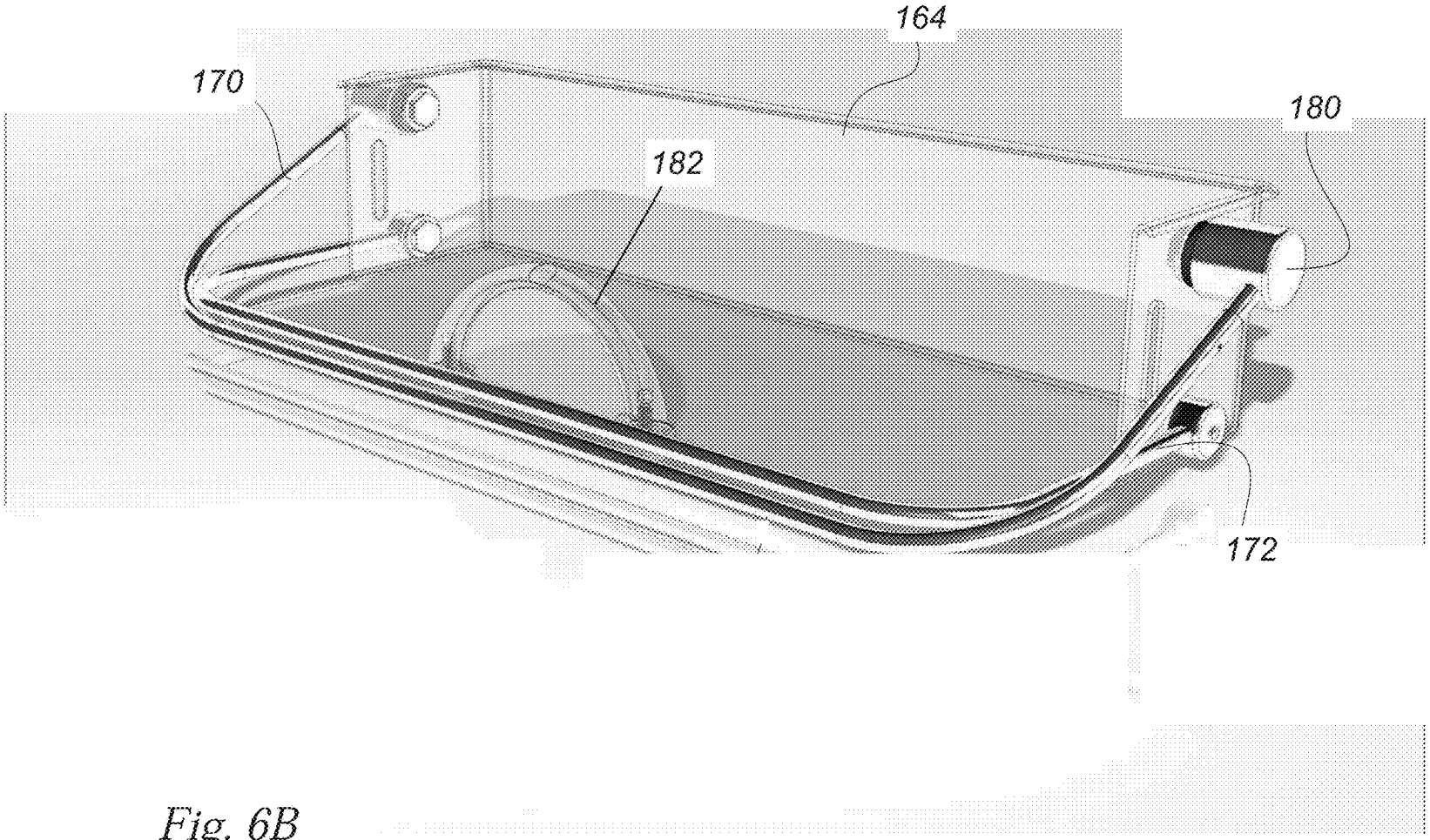

FIG. 6 is a perspective view of a further alternative over-the-bed easy-access bassinet 160 of the present application, and FIGS. 6A-6B are perspective views thereof. The bassinet 160 again includes a lower frame member 162 to which is mounted an upstanding rear wall 164 and abbreviated end walls 166. A convertible front wall 168 includes a pair of U-shaped bars 170, 172 each having their free ends mounted to respective end walls 166. More particularly, the end walls 166 extend forward from the rear wall 164 approximately half of the total width of the bassinet 160 such that the bars 170, 172 extend the rest of the width of the bassinet and around the front. A removable mesh or fabric cover 174 is secured to both of the U-shaped bars 170, 172 and provides a barrier to the baby rolling out of the bassinet on both the front and half of the ends thereof. The walls 164, 166, 168 define the bassinet enclosure.

Foam or other such padded sleeves 176 are provided on the top and bottom edges of the cover 174 to enhance comfort to both the mother and the baby. That is, the flexible fabric cover 174 includes elongated sleeves 176 on top and bottom horizontal edges that received the upper and lower bars 170, 172. Of course, rather than providing tunnel-like sleeves 176 and sliding the cover 174 onto the bars in this manner, an elongated Velcro wrap may form the elongated horizontal sleeves which obviates the need to remove the bars 170, 172 to detach the cover. Again, exemplary dimensions for the bassinet 160 are shown in FIG. 6, which may be varied by up to 10%.

The front wall 168 is convertible from its raised configuration seen in FIG. 6, and its lowered configuration seen in FIG. 6B. It should be noted that the cover 174 is removable and not shown for the sake of clarity in FIGS. 6A-6B. To convert the front wall 168, the user need only pressed down on the upper U-shaped bar 170 which is mounted to pivot about journal assemblies 180 secured to the abbreviated end walls 166. The lower bar 172 may also pivot downward, but is desirably fixed in a horizontal orientation as shown. In a preferred embodiment, the journal assemblies 180 incorporate a spring mechanism so that the upper bar 170 is biased upward. In this manner, the mother can reach in lower the bar to attend to the baby, but then need only retract her arms so that the front wall 168 assumes its raised configuration again.

The bassinet 160 also includes a partial barrier wall 182 just inside the front wall 168. Once again, the barrier wall 182 comprises an arch-shaped member that is preferably detachable from the lower frame member 162. Even when the front wall 168 is pressed downward, the partial barrier wall 182 maintains an impediment to the baby rolling out of the bassinet on the front side. As before, the barrier wall 182 has a gently curving shape and is desirably padded to provide comfort to the baby and the mother. Further, the barrier wall 182 preferably has a length of between about 20-50% of the total length of the bassinet, and more preferably between about 30-40%.

Figures 7A, 7B:
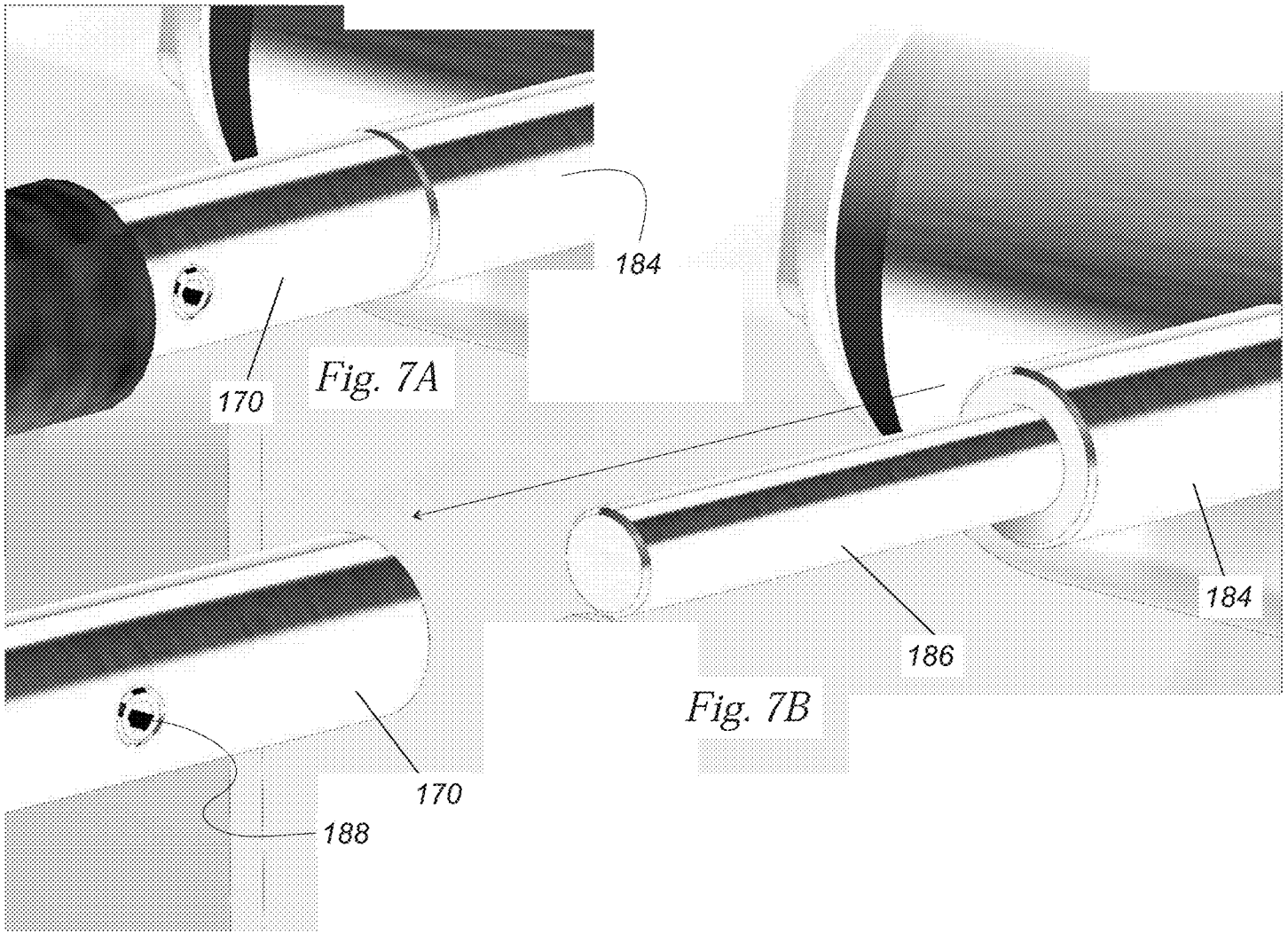
FIGS. 7A and 7B are enlarged views of one embodiment of a detachable front bar for taking off and putting on the mesh panel of the bassinet of FIG. 6.

FIGS. 7A and 7B are enlarged views of one embodiment of a detachable front bar 170 for taking off and putting on the mesh panel 174 of the bassinet of FIG. 6. A short horizontal shaft member 184 fixed to pivot about the journal assembly 180 includes a reduced diameter end portion 186. Each free end of the U-shaped bar 170 has a short cylindrical cavity (not shown) that closely receives the reduced diameter end portion 186. To secure the two pieces together, set screws 188 on the free ends of the U-shaped bar 170 are provided. Of course, there are other mechanisms for securing the U-shape bar 170 in place, and in particular a quick-release mechanism utilizing a spring-loaded detente or other such a mechanical fastener may be substituted to avoid the need for an Allen wrench or other tool. By releasing the bars 170, 172 in this manner, the mesh panel 174 can be slid off the bars for cleaning or replacement. As seen in FIG. 6, straps or bands 190 of Velcro or other such flexible fastener are provided on each rear end edge of the mesh panel 174 that may pass through vertical slots 92 in the abbreviated end walls 166 to firmly hold the panel in place.

Should the mother choose to use a newborn's bed as the surface to support the newborn when she is breastfeeding, the mother may unintentionally fall asleep while feeding her newborn, and the newborn could possibly roll off of its bed onto the mother's bed. This endangers the newborn, as the sleeping mother could accidentally lie on top of her newborn. To help prevent this safety issue from occurring, the small partial barrier attached to the front of the newborn's bed frame is included, creating a barrier between the mother and the newborn that would still permit the mother access to her newborn, but prevent the newborn from coming off its bed onto the mother's mattress.

The barrier would be a hill shaped wall that is attached to the side wall of the bassinet. The barrier would be attached to the newborn's bed and serve as a divider, preventing the newborn from rolling off its bed. A clear plastic or acrylic bassinet side wall, when lowered and pushed under the newborn's bed, and held in place by a small track directly under and attached to the bottom of the newborn's bed, would be in place when the mother is not interacting with her newborn. The clear plastic rigid side wall, when in its upright position, will serve as protection when the newborn is being moved while in the bassinet that is on a wheeled stand.

The barrier would be somewhere between 6-8 inches long and 4-6 inches tall, and be situated front and center, thus creating a partial wall between the newborn and the mother who is in a side lying position. The newborn's head and legs would be unobstructed, allowing the mother to access the newborn's head and chest and to encircle her arms around her newborn while resting her arms on the newborn's sleeping surface.

The barrier (wall) could be made to be removable, using a clip or some other attachment device, or the barrier could be fastened to the platform of the infant's sleeping surface, and have the capacity to fold down under the mattress, when not in use. The barrier (wall) should be made of a material that would be strong enough to stand vertically, but also, have rounded smooth edges. The barrier would be constructed in a way that the mother would be able to lay on her side and breastfeed her newborn, while her newborn is laying on its own sleeping surface. The mother would also be able to access feeding her newborn using the newborn's bed as a support for the newborn when the mother is in a sitting position, if the bassinet is on a stand that allows the bassinet to swing over the mother's bed or chair. Once again the mother's arms would rest on the newborn's mattress encircling the newborn as she feeds. The barrier would allow mother access to the newborn's head and chest, but prevent the newborn's body from rolling off its mattress.

The bassinet would consist of 2 separate parts. The first part consists of a rigid shell that can be made of plastic, or can be constructed with light weight interconnected tubes, that can be held together by hinges, if so desired by the manufacturer, or can be made of one solid form. The plastic shell may also have 2 moveable plastic side walls that can be pulled away from the bassinet, and then made to slide directly under and flush with the underside of the bassinet floor.

The second part would be consist of a fabric sleeve that is designed to secure two mesh side walls to the bassinet shell with elastic straps, or snaps, or Velcro, regulated by safety guidelines. Once the mesh sleeve is in place, it would create two mesh side walls that can be pressed down by the mother when she is accessing her newborn, and when the mother's arms are removed from inside of the bassinet, the mesh side wall would return to its original upright position by means of an elastic band at the top of the mesh wall. The barrier that is attached to the frame of the bassinet would serve as a means to keep the newborn from being able to be partially off of the bed while mother is interacting with her newborn, such as when she is nursing her newborn, or changing her newborn's diaper while the newborn remains in the bassinet.

The side walls are designed to allow the mother easy access to her newborn when removing and returning her newborn into the bassinet. Also, the mother can hold and feed her newborn, using the newborn's bed surface to support her arms. The floor of the bassinet and the newborn's mattress support's the newborn's weight, reducing the strain on the mother's shoulders, back, arms and torso. Should the mother unintentionally fall asleep while feeding her newborn and move away from the bassinet, the infant would remain safely in the bassinet, and the barrier wall in front of the newborn, would prevent the newborn from rolling off of its bed. The mesh walls would be restored to their upright position automatically as the mother moves away from the bassinet.

If the basket of the bassinet is made of a sturdy material, such as a clear plastic, there will be two outer plastic side walls that can be pushed down and under the newborn's bassinet, so that when the side wall is pushed down, it is under and flush to the bottom of the newborn's bassinet. The outer side walls can be made to be raised and lowered manually, or could have an automatic restoring mechanism such as a spring so that if the mother's arms are removed from over the bassinet, the plastic side walls would automatically return to their original upright position. The rigid outer side walls that raise and lower, can be optional. There can be a bassinet (such as for the home), that does not need to have an outer protective side wall in place.

There can also be a portable bassinet that is made of a sturdy collapsible shell that the mesh sleeve fits over and attaches to. The side mesh walls will keep the newborn enclosed but still allow the mother access to her newborn while the newborn is inside of the bassinet.

The portable version could potentially have the capacity to be attached and removed from a stand that can be placed by the mother's bed or chair, and can be moved over the bed or chair to provide the mother easy access to her newborn. The removable basket could potentially be used, separate from a stand, for when the newborn needs a bed outside of the home.

While the invention has been described in its preferred embodiments, the words which have been used are words of description and not of limitation. Therefore, changes may be made within the appended claims without departing from the true scope of the invention.

What is claimed is:

1. A bassinet having: a lower frame adapted to support a sleeping platform for a baby; a plurality of enclosure walls mounted around a periphery of the lower frame that present a complete barrier to a baby rolling off the sleeping platform when in a raised configuration, at least one of the enclosure walls being a convertible wall configured to move from a raised position to a lowered position at or below a level of the sleeping platform, wherein the front wall includes a pair of U-shaped bars, comprising a lower bar and an upper bar, and wherein the upper bar has a front bar and a pair of rearwardly-extending bars that are journaled for rotation about a common horizontal axis parallel to the front wall so that the upper bar may pivot from a raised position to a lowered position, and further including a flexible fabric panel secured to both the lower and upper bars so as to form a part of the complete barrier to a baby rolling off the sleeping platform when the upper bar is in the raised position; and a partial barrier wall positioned adjacent to and just inside the convertible wall, the partial barrier wall being shorter than the convertible wall and formed with curves and no sharp edges.

2. The bassinet of claim 1, further including a stand that supports the lower frame in a cantilevered manner so that the bassinet may be positioned over a bed.

3. The bassinet of claim 1, wherein the partial barrier wall is padded.

4. The bassinet of claim 1, wherein the enclosure walls define a generally rectangular shape for the bassinet having a length and a width, and the partial barrier wall has a length of between about 20-50% of the length of the bassinet.

5. The bassinet of claim 1, wherein the partial barrier wall has a convex curved upper edge that curves down to the level of the sleeping platform.

6. The bassinet of claim 5, wherein the partial barrier wall is arch-shaped with a lower opening.

7. The bassinet of claim 1, wherein the plurality of enclosure walls comprise a rigid rear wall and a pair of rigid abbreviated end walls which extend forward from the rear wall about half of a width dimension of the bassinet, and wherein the common horizontal axis runs through the abbreviated end walls and the rearwardly-extending bars of the front bar are pivotally connected thereto.

8. The bassinet of claim 1, wherein the partial barrier wall has a length of about 4-8 inches and a height of about 4-6 inches.

9. The bassinet of claim 7, wherein both upper and lower bars are detachable from the abbreviated end walls and the flexible fabric panel includes elongated horizontal sleeves on top and bottom edges that received the upper and lower bars, respectively, the flexible fabric panel being removable for washing or replacement.

10. A bassinet having: a lower frame adapted to support a sleeping platform for a baby; a plurality of enclosure walls mounted around a periphery of the lower frame that present a complete barrier to a baby rolling off the sleeping platform, at least one of the enclosure walls being a flexible fabric panel that may be lowered to a position at or below a level of the sleeping platform, the flexible fabric panel being easily removable from the bassinet for cleaning or replacement; wherein the enclosure walls including a front wall having a pair of U-shaped bars, comprising a lower bar and an upper bar, and wherein the upper bar has a front bar and a pair of rearwardly- extending bars that are journaled for rotation about a common horizontal axis parallel to the front wall so that the upper bar may pivot from a raised position to a lowered position, and wherein the flexible fabric panel is secured to both the lower and upper bars so as to form a part of the complete barrier to a baby rolling off the sleeping platform when the upper bar is in the raised position.

11. The bassinet of claim 10, further including a stand that supports the lower frame in a cantilevered manner so that the bassinet may be positioned over a bed.

12. The bassinet of claim 10, further including a partial barrier wall positioned adjacent to and adjacent the flexible fabric panel, the partial barrier wall being shorter than the flexible fabric panel and formed with curves and no sharp edges, the partial barrier wall having a length of between about 20-50% of the length of the bassinet.

13. The bassinet of claim 12, wherein the partial barrier wall has a convex curved upper edge that curves down to the level of the sleeping platform.

14. The bassinet of claim 10, wherein the plurality of enclosure walls comprise a rigid rear wall and a pair of rigid abbreviated end walls which extend forward from the rear wall about half of a width dimension of the bassinet, and wherein the common horizontal axis runs through the abbreviated end walls and the rearwardly-extending bars of the front bar are pivotally connected thereto.

15. The bassinet of claim 12, wherein the partial barrier wall has a length of about 4-8 inches and a height of about 4-6 inches.

16. The bassinet of claim 14, wherein both upper and lower bars are detachable from the abbreviated end walls and the flexible fabric panel includes elongated sleeves on top and bottom edges that receive the upper and lower bars.

* * * * *